US009039225B2

(12) United States Patent
Yu et al.

(10) Patent No.: US 9,039,225 B2
(45) Date of Patent: May 26, 2015

(54) LED ILLUMINATING SHOWCASE

(71) Applicant: DIODE-ON OPTOELECTRONICS LIMITED, Taichung (TW)

(72) Inventors: Jui-Tsun Yu, Taichung (TW); Ming-Hui Hung, Taichung (TW)

(73) Assignee: Diode-On Optoelectronics Limited, Taichung (TW)

( * ) Notice: Subject to any disclaimer, the term of this patent is extended or adjusted under 35 U.S.C. 154(b) by 50 days.

(21) Appl. No.: 14/078,914

(22) Filed: Nov. 13, 2013

(65) Prior Publication Data

US 2014/0340878 A1 Nov. 20, 2014

(30) Foreign Application Priority Data

May 16, 2013 (TW) ..... 102209139 U

(51) Int. Cl.

| | |
|---|---|
| ***A47F 3/00*** | (2006.01) |
| *F21V 19/00* | (2006.01) |
| *A47F 11/10* | (2006.01) |

(52) U.S. Cl.

CPC ..... *A47F 3/001* (2013.01); *F21V 19/0005* (2013.01); *A47F 3/005* (2013.01); *A47F 11/10* (2013.01)

(58) Field of Classification Search

CPC ..... A47F 3/00; A47F 3/001; A47F 3/005; A47F 11/00; A47F 11/10; F21V 17/06; F21V 19/00; F21V 19/0005; F21V 19/001; F21V 19/006

See application file for complete search history.

(56) References Cited

U.S. PATENT DOCUMENTS

| | | | | |
|---|---|---|---|---|
| 2,840,228 | A * | 6/1958 | Takacs | 206/769 |
| 7,146,760 | B2 * | 12/2006 | Yiu | 40/743 |
| 7,513,777 | B2 * | 4/2009 | Schneider et al. | 439/56 |
| 7,700,894 | B2 * | 4/2010 | Quella | 219/214 |

* cited by examiner

*Primary Examiner* — Bao Q Truong

(74) *Attorney, Agent, or Firm* — Faegre Baker Daniels LLP

(57) ABSTRACT

An LED illuminating showcase includes a frame unit and a lighting unit. The frame unit includes bottom and top seat covers, and a transparent tubular shell extending from the bottom seat cover to the top seat cover and defining a display space with the seat covers. The lighting unit includes opposite terminal subunits respectively disposed in the seat covers, a connecting bar connected fixedly to an inner surface of the tubular shell, having two ends that abut respectively against the seat covers, and that are connected respectively and electrically to the terminal subunits, and an LED module embedded in the top seat cover for illuminating the display space.

5 Claims, 5 Drawing Sheets

LED ILLUMINATING SHOWCASE

CROSS REFERENCE TO RELATED APPLICATION

The present application claims priority of Taiwanese Application No. 102209139, filed on May 16, 2013, the entire disclosure of which is hereby expressly incorporated by reference herein.

BACKGROUND

1. Technical Field

The invention relates to a showcase, particularly to an LED illuminating showcase.

2. Description of the Related Art

With reference to FIG. 1, an conventional showcase usually has a transparent shell 12 on a seat 11 to cover and prevent damages to a displayed item 13.

With reference to FIG. 2, lighting is often used to enhance display effects. Taiwanese Patent No. M289114 discloses another conventional showcase with a projecting lamp 14 attached to a backboard 16 and above a displayed item 15. A visible lamp structure not only negatively affects the aesthetic appeal, but also shifts the focus from the displayed item 15.

SUMMARY

Therefore, the object of the present invention is to provide a Light Emitting Diode (LED) illuminating showcase that can eliminate the aforesaid drawbacks of the prior art.

According to the present invention, there is provided an LED illuminating showcase including a frame unit and a lighting unit. The frame unit includes a bottom seat cover, a top seat cover spaced apart from the bottom seat cover, and a transparent tubular shell extending from the bottom seat cover to the top seat cover. The transparent tubular shell cooperates with the top and bottom seat covers to define a display space thereamong.

The lighting unit includes opposite terminal subunits that are respectively mounted to the bottom seat cover and the top seat cover, a connecting bar that is connected fixedly to an inner surface of the transparent tubular shell, that has two ends abutting respectively against the bottom seat cover and the top seat cover and connected respectively and electrically to the terminal subunits, an LED module that is embedded in the top seat cover and that is electrically connected to a corresponding one of the terminal subunits in the top seat cover for illuminating the display space, a power source that is embedded in the bottom seat cover and that is connected electrically to a corresponding one of the terminal subunits in the bottom seat cover, and a switch that is disposed on the frame unit for turning on or off the LED module.

BRIEF DESCRIPTION OF THE DRAWINGS

Other features and advantages of the present invention will become apparent in the following detailed description of the preferred embodiment with reference to the accompanying drawings, of which.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 3:
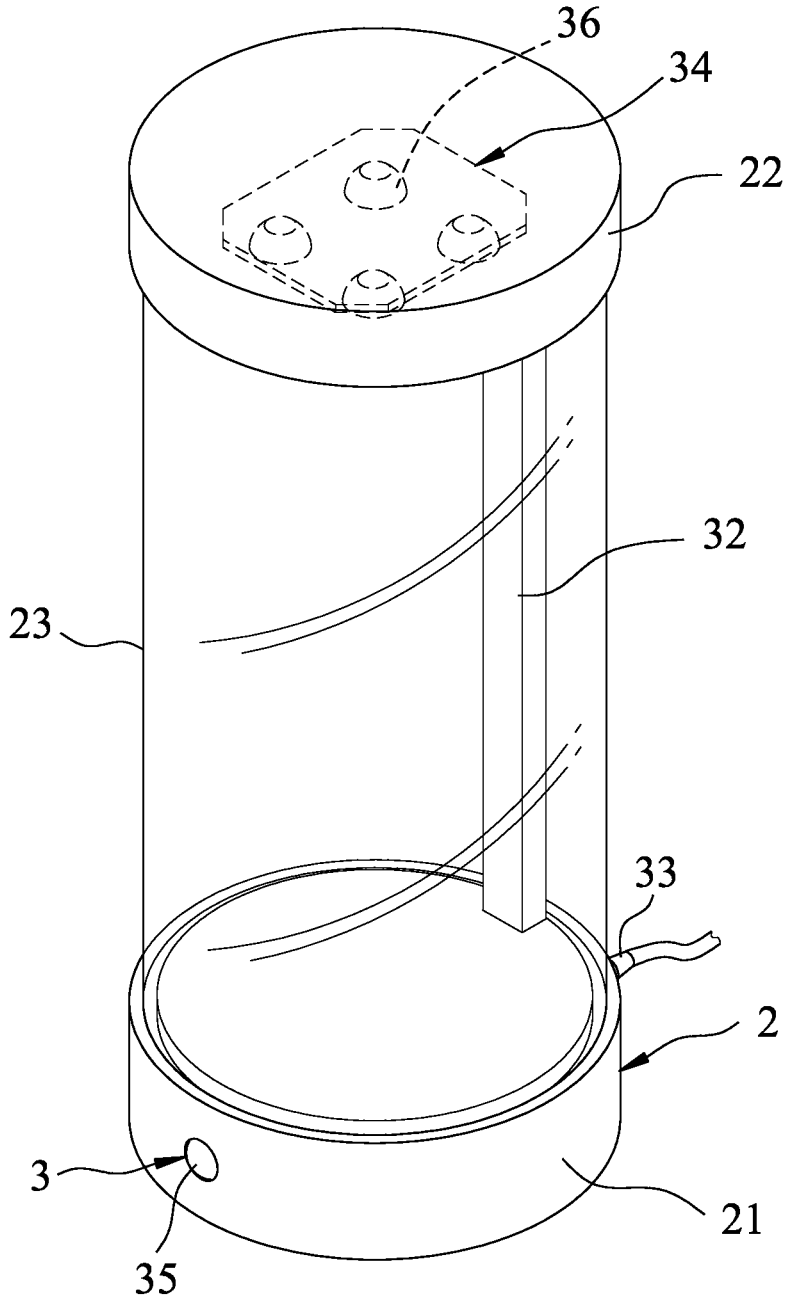
FIG. 3 is a fragmentary perspective view of the preferred embodiment of an LED illuminating showcase according to the present invention.
Figure 4:
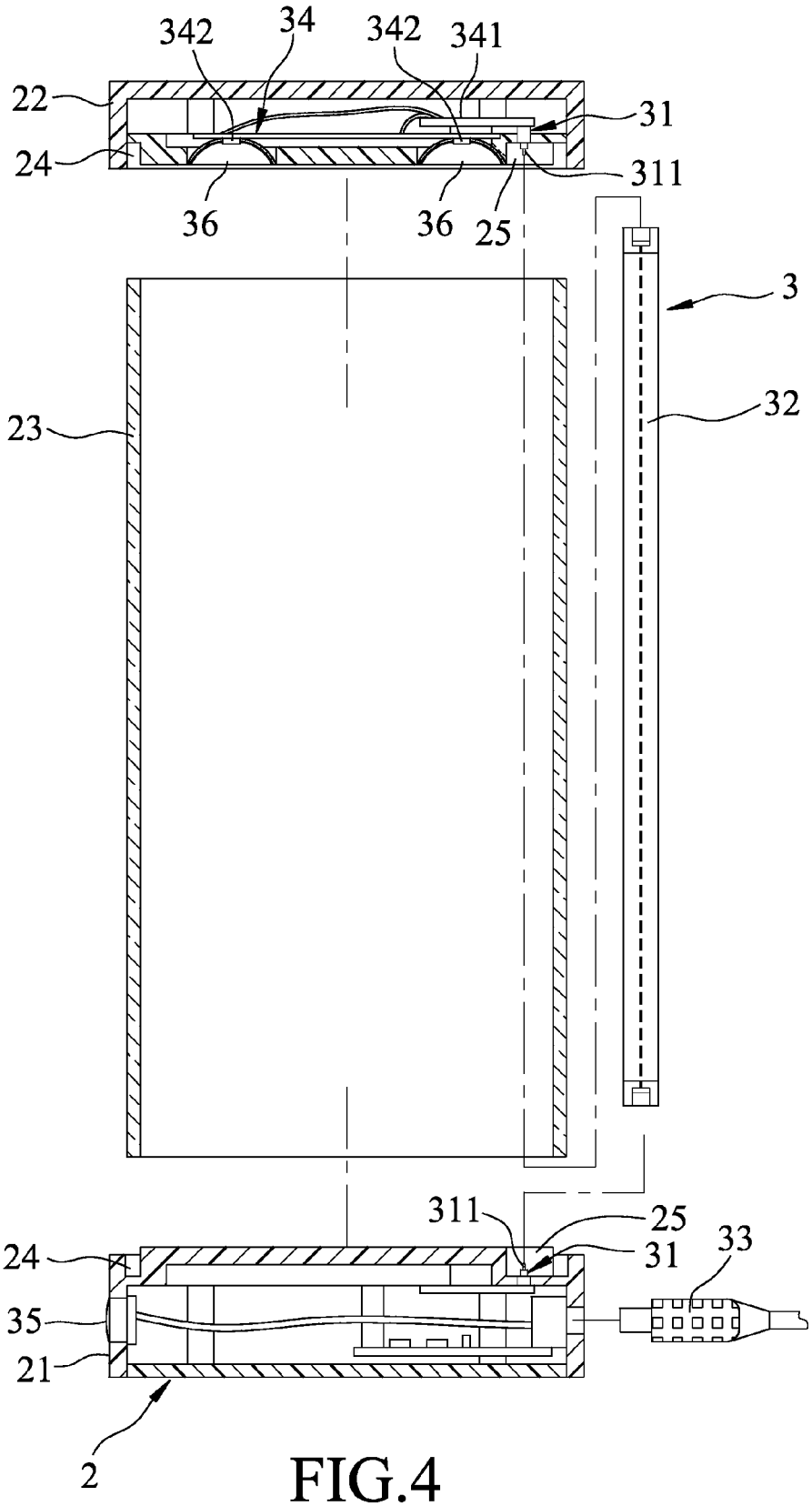
FIG. 4 is fragmentary exploded sectional view of the preferred embodiment.
Figure 5:
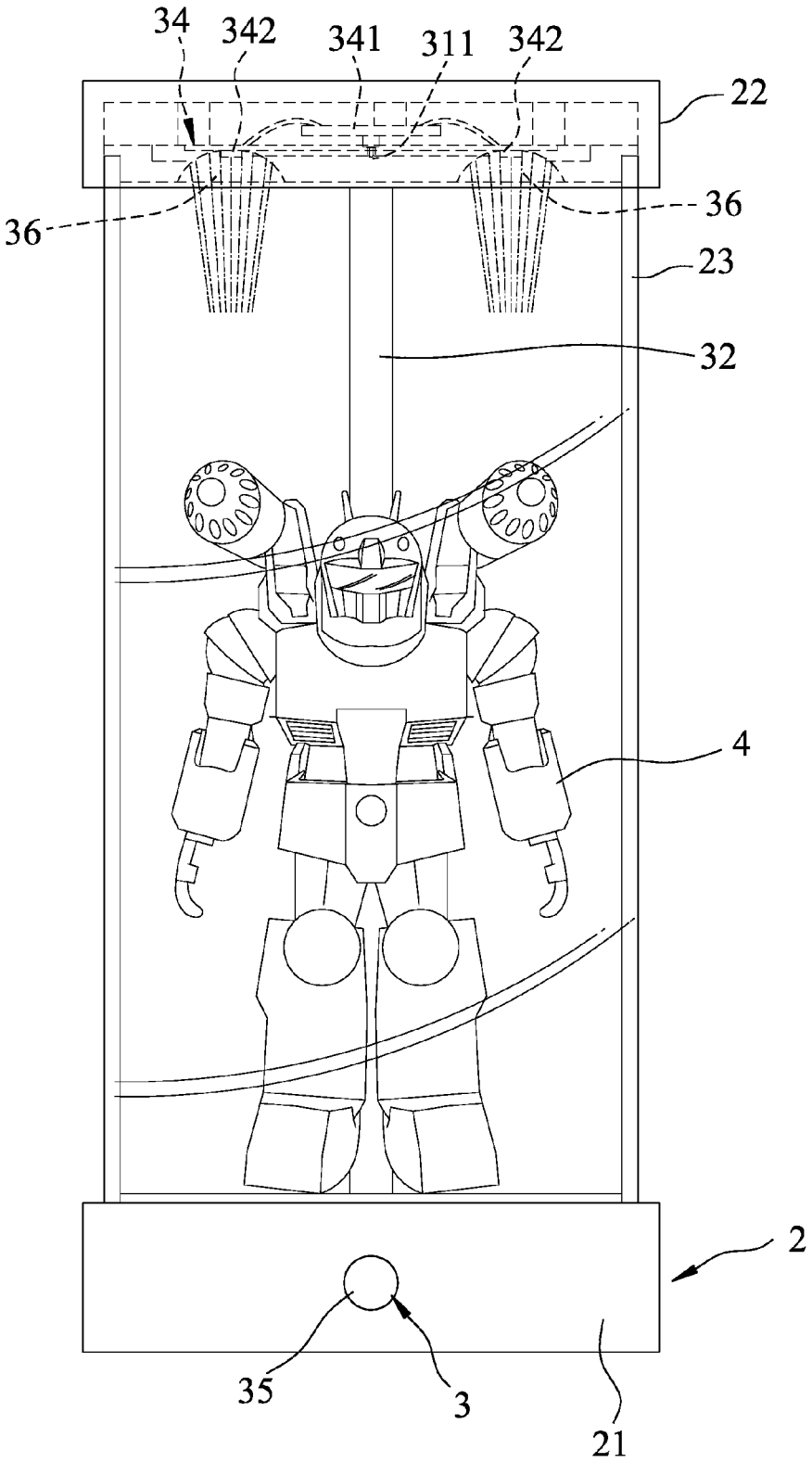
FIG. 5 is a schematic front view of the preferred embodiment.

With reference to FIGS. 3, 4 and 5, the preferred embodiment of an LED illuminating showcase according to the present invention includes a frame unit 2 and a lighting unit 3.

The frame unit 2 includes a bottom seat cover 21, a top seat cover 22 spaced apart from the bottom seat cover 21, and a transparent tubular shell 23 extending from the bottom seat cover 21 to the top seat cover 22. Each of the bottom seat cover 21 and the top seat cover 22 has a circular groove 24 engaged with a respective one of a bottom end and a top end of the transparent tubular shell 23, and a connecting groove 25.

The lighting unit 3 includes two opposite terminal subunits 31, a connecting bar 32, a power source 33, an LED module 34, a switch 35 and a plurality of light guides 36.

Each of the terminal subunits 31 is disposed in the connecting groove 25 of a respective one of the top and bottom seat covers 22, 21. Each of the terminal subunits 31 has at least a pin 311 extending retractably and outwardly of the connecting grooves 25 of the respective one of the top and bottom seat covers 22, 21.

The connecting bar 32 is connected fixedly to an inner surface of the transparent tubular shell 23, has two ends each of which abuts against the pin 311 in the connecting groove 25 of a respective one of the bottom and top seat covers 21, 22, connected electrically to a respective one of the terminal subunits 31, and engaged with the connecting grooves 25 of the respective one of the bottom and top seat covers 21, 22.

The power source 33 is electrically connected to a corresponding one of the terminal subunits 31 in the bottom seat cover 21. In this embodiment, the power source 33 is in the form of a power adaptor. Alternatively, the power source 33 may be one or more batteries disposed in the bottom seat cover 21.

The LED module 34 is embedded in the top seat cover 22 and is electrically connected to a corresponding one of the terminal subunits 31 of the top seat cover 22 for illuminating the display space. The LED module 34 includes a circuit board 341 disposed in the top seat cover 22, and a plurality of LEDs 342 spaced apart from each other and disposed in the top seat cover 22 for illuminating the display space. The power source 33 supplies power to the LED module 34 via the terminal subunits 31 and the connecting bar 32.

The switch 35 is disposed on the frame unit 2 and may control the LEDs 342 to switch on or off. The switch 35 may further control the LEDs 342 to emit light of different brightness, colors and color temperatures. In this embodiment, the switch 35 in the form of a push button, but may as well be a remote control switch.

The light guides 36 are embedded in the top seat cover 22 and guide the light emitted by the LEDs 342 toward a displayed item 4 that is disposed in the display space.

Figure 1:
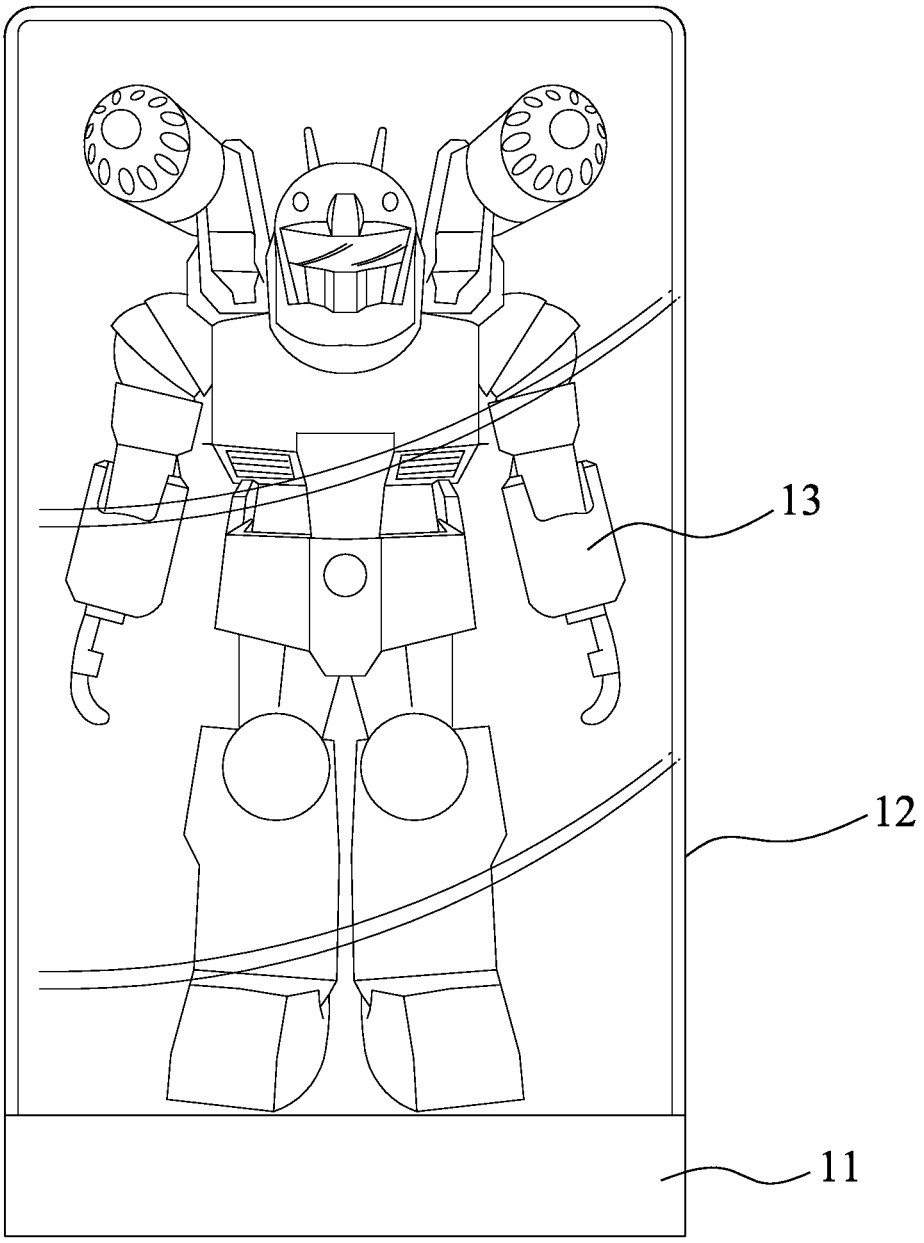
FIG.1 PRIOR ART
FIG. 1 is a side view of a conventional showcase.
Figure 2:
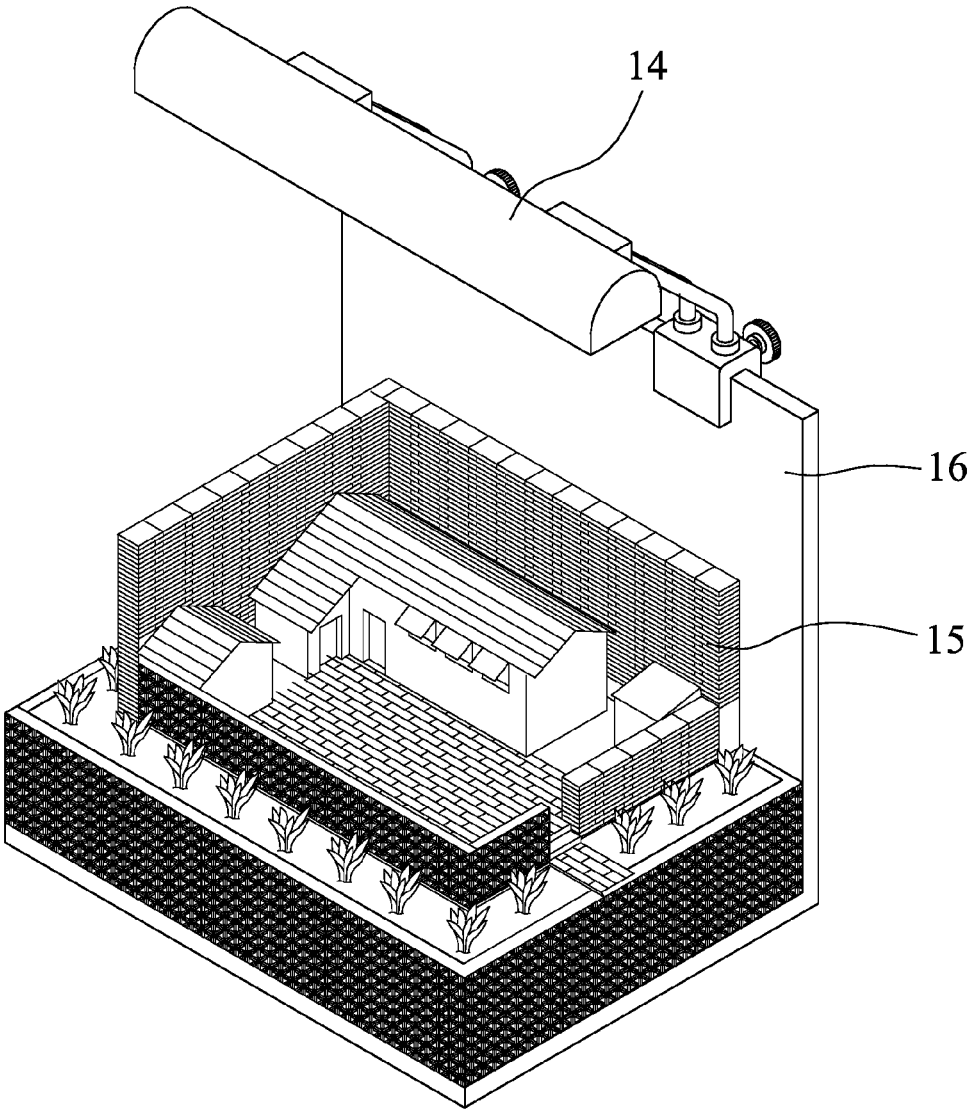
FIG.2 PRIOR ART
FIG. 2 is a perspective view of another conventional showcase disclosed by Taiwanese Patent No. M289114.

Advantages and effects of the LED illuminating showcase of the present invention can be summarized as follows:

Firstly, in contrast to a showcase of the prior art (see FIG. 2) where the light emitted by an attached lamp 14 is scattered and the structure of the lamp 14 is exposed, the LED illuminating showcase of the present invention has the lighting unit 3 embedded to enhance aesthetic appeal and is provided with the light guide 36 to converge the light emitted by the LEDs 342 toward the display space. In addition, the LED module 34 can be controlled to have different lighting schemes for enhanced display effects. Therefore, the LED illuminating showcase of this invention not only protects the displayed item 4, but also enhances the aesthetic appeal and display effects of the display.

Second, the utilization of the pins 311 for the terminal subunits 31 make it easier to connect with the connecting bar 32 and also easier to assemble and maintain. For composing another LED illuminating showcase with a different height, only the transparent tubular shell 23 and the connecting bar 32 need to be replaced, while the bottom seat cover 21, the top seat cover 22 and other parts may still be used. Hence, the usage of the LED illuminating showcase is more versatile.

It should be noted that should it become necessary to add a background behind the displayed item 4, a connecting structure may be added between the connecting bar 32 and the background decoration to add extra versatilities to the display.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A Light Emitting Diode (LED) illuminating showcase comprising:

a frame unit having a bottom seat cover, a top seat cover that is spaced apart from said bottom seat cover, and a transparent tubular shell that extends from said bottom seat cover to said top seat cover and that cooperates with said bottom seat cover and said top seat cover to define a display space thereamong; and a lighting unit including opposite terminal subunits that are respectively disposed in said bottom seat cover and said top seat cover, a connecting bar that is connected fixedly to an inner surface of said transparent tubular shell, that has two ends abutting respectively against said bottom seat cover and said top seat cover and connected respectively and electrically to said terminal subunits, an LED module that is embedded in said top seat cover and that is connected electrically to a corresponding one of said terminal subunits in said top seat cover for illuminating said display space, a power source that is embedded in said bottom seat cover and that is connected electrically to a corresponding one of said terminal subunits in said bottom seat cover, and a switch that is disposed on said frame unit for turning on or off said LED module.

2. The LED illuminating showcase of claim 1, wherein said LED module of said lighting unit includes a circuit board that is disposed in said top seat cover, and a plurality of LEDs that are spaced apart from each other and that are disposed in said top seat cover for illuminating said display space.

3. The LED illuminating showcase of claim 2, wherein said LEDs of said lighting unit are controlled by said switch to emit light of different brightness, colors and color temperatures.

4. The LED illuminating showcase of claim 1, wherein each of said terminal subunits of said lighting unit includes a pin that extends retractably and outwardly of a corresponding one of said bottom seat cover and said top seat cover.

5. The LED illuminating showcase of claim 1, wherein each of said bottom seat cover and said top seat cover has a circular groove engaged with a respective one of a bottom end and a top end of said transparent tubular shell, and a connecting groove engaged with a respective one of said two ends of said connecting bar, each of said terminal subunits being disposed in said connecting groove of the respective one of said top and bottom seat covers.

* * * * *